US008235180B2

(12) United States Patent
Kattainen et al.

(10) Patent No.: US 8,235,180 B2
(45) Date of Patent: Aug. 7, 2012

(54) ELEVATOR SYSTEM WITH A BRAKE CONTROL CIRCUIT USING A CONTROLLABLE SWITCH SWITCHED WITH SHORT PULSES

(75) Inventors: Ari Kattainen, Hyvinkää (FI); Jyrki Laaksonheimo, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/188,980

(22) Filed: Jul. 22, 2011

(65) Prior Publication Data

US 2011/0278099 A1 Nov. 17, 2011

Related U.S. Application Data

(63) Continuation of application No. PCT/FI2010/000013, filed on Feb. 17, 2010.

(30) Foreign Application Priority Data

Mar. 5, 2009 (FI) ..... 20090081

(51) Int. Cl.
*B66B 1/32* (2006.01)

(52) U.S. Cl. ..... 187/288; 187/391

(58) Field of Classification Search ..... 187/277, 187/286, 287, 288, 289, 293, 296, 297, 391–393; 218/376, 799–815

See application file for complete search history.

(56) References Cited

U.S. PATENT DOCUMENTS

| | | | | | |
|---|---|---|---|---|---|
| 3,961,688 | A * | 6/1976 | Maynard | 187/289 |
| 4,046,229 | A * | 9/1977 | Kernick et al. | 187/293 |
| 4,102,436 | A * | 7/1978 | Kernick et al. | 187/293 |
| 4,337,847 | A * | 7/1982 | Schroder et al. | 187/247 |
| 4,493,398 | A * | 1/1985 | Kindler | 187/296 |
| 5,153,389 | A | 10/1992 | Nomura | |
| 5,170,105 | A * | 12/1992 | Kumar | 318/362 |
| 6,311,801 | B1 * | 11/2001 | Takagi et al. | 187/290 |
| 6,949,908 | B2 * | 9/2005 | Maslov et al. | 318/727 |
| 7,614,481 | B2 * | 11/2009 | Okamoto et al. | 187/305 |
| 7,729,806 | B2 * | 6/2010 | Ohira | 700/275 |
| 2009/0229924 | A1 | 9/2009 | Kondo et al. | |

FOREIGN PATENT DOCUMENTS

| | | | |
|---|---|---|---|
| CN | 101367479 | A | 2/2009 |
| JP | 2004-131207 | A | 4/2004 |
| JP | 2008-120469 | A | 5/2008 |
| WO | WO 2007/125155 | A1 | 11/2007 |
| WO | WO 2008/015749 | A1 | 2/2008 |

* cited by examiner

*Primary Examiner* — Anthony Salata
(74) *Attorney, Agent, or Firm* — Birch, Stewart, Kolasch & Birch, LLP

(57) ABSTRACT

An elevator system and a brake control circuit include a first switch that controls the electricity supply of the winding of the brake, which switch is connected in a controlled manner with the control of the electricity supply of the winding of the brake, and thus the braking function is controlled.

20 Claims, 5 Drawing Sheets

1: brake control circuit
2, 2': electromechanical brakes
13: electronic monitoring unit
14: movement control system
15: elevator car
17: hoisting machine
18: movement signals
19: motor control unit
20: traction sheave
28: counterweight
29: electricity network 1: brake control circuit
3: excitation winding
13: electronic monitoring unit
14, 14': movement control system
34: communication bus
35: monitoring unit 16: movement reference
18: movement signals
36: regulator
37: regulator
39: pulse-width modulator 1: brake control circuit
2: electromechanical brakes
3: excitation winding
24, 24': helical springs
25, 25': ferromagnetic parts
26: braking surface
27: brake pad
28: air gap

ELEVATOR SYSTEM WITH A BRAKE CONTROL CIRCUIT USING A CONTROLLABLE SWITCH SWITCHED WITH SHORT PULSES

CROSS REFERENCE TO RELATED APPLICATIONS

This application is a Continuation of PCT/FI2010/000013 filed on Feb. 17, 2010, which claims priority of Application No. FI20090081 filed in Finland on Mar. 5, 2009, all of which are hereby expressly incorporated by reference into the present application.

BACKGROUND OF THE INVENTION

1. Field of the Invention

The present invention relates to a brake control circuit, an elevator system as defined in the preamble of claim 9, and also a method for controlling the brake of the elevator system.

2. Background of the Invention

It is very general to use a machinery brake that mechanically connects with a rotating part of the elevator machine as a braking apparatus of an elevator car. The machinery brake can be in its structure e.g. a drum brake or a disc brake. The braking function of a machinery brake is conventionally activated by disconnecting the electricity supply circuit of the brake control winding, e.g. with a relay or contactor. After the electricity supply of the brake has been disconnected the brake closes, in which case brake pad attached to the brake shoe connects mechanically with a rotating part of the machine. The closing of the brake occurs with a closing delay, which is determined from the electrical parameters of the brake and of a possible attenuation circuit, such as from the inductance and resistance of the brake, as well as from the impedance of the possible attenuation circuit.

The force exerted by a brake is generally quite large, so that when activating the braking function e.g. in connection with an emergency stop, the brake pad engages to brake the movement of the elevator car with the kind of deceleration of movement that might feel uncomfortable to a passenger in the elevator car.

Rather a lot of kinetic energy is also generated when the brake operates. This produces a loud noise when the brake pad hits against the braking surface. To solve this problem the aim has been for the distance between the brake pad and the braking surface to be as small as possible. In this case the brake pad does not have time to achieve a very great speed and kinetic energy when it hits closed, as a result of which the impact is more subdued. An air gap that is small enough is, however, difficult to implement and also to adjust, and this type of solution results in a very fragile structure and also in extremely precise manufacturing tolerances.

The operation of a brake of an elevator can be affected also by adjusting the current of the brake. Publication JP 2008120521 presents one such type of adjustment of the brake current wherein the braking force is measured from the brake drum with a special pressure sensor, and the current of the excitation winding of the brake is adjusted on the basis of the measuring signal of the pressure sensor. In this case the braking force can be affected with the adjustment of the brake current.

Publication JP 2008120469 presents an arrangement wherein it is endeavored to reduce the noise produced by the operation of a brake by changing the impedance of the electricity supply circuit of the brake in stages such that the change in impedance also affects the magnitude of the brake current.

SUMMARY OF THE INVENTION

The aim of this invention is to solve the aforementioned drawbacks as well as the drawbacks disclosed in the description of the invention below. In this case a brake control circuit of an elevator is presented as an invention, which brake control circuit is simpler than prior art. By means of the brake control circuit the operation of a brake of an elevator can be controlled so that the level of operation of the elevator system improves. In this case by means of the brake control circuit according to the invention a safer and more pleasant user experience from the viewpoint of an elevator passenger can be achieved, particularly in an emergency stop of the elevator.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

The brake control circuit according to the invention comprises a first switch that controls the electricity supply of the winding of the brake, which switch is switched in a controlled manner with short pulses by the control of the electricity supply of the winding of the brake, and thus the braking function is controlled. In this case e.g. the voltage between the poles of the winding of the brake and/or the current flowing through the winding can be adjusted according to a predefined reference. Since the instantaneous current of the winding affects the instantaneous value of the force exerted on the brake shoe, the force exerted on the brake shoe can in this way be adjusted according to the objective of the operation of the elevator at any given time. The current profile of the winding of the brake can be selected e.g. so that the impact caused by the opening movement or closing movement of the brake is moderated. On the other hand, during an emergency stop of the elevator the movement of the elevator car can be adjusted, on certain conditions, by controlling the current flowing through the winding of the brake and thus the braking force.

In one embodiment of the invention, after the electricity supply of the winding of the brake has been disconnected, the energy stored in the winding is discharged into the intermediate circuit of the brake control circuit via the release branch. In this case the magnetization energy stored in the winding of the brake can be collected. At the same time also the conventional attenuation circuit of the current of the brake, in which the magnetization energy of the winding of the brake is converted into heat, can be omitted or the dimensioning of it can at least be reduced.

In one embodiment of the invention, when the voltage of the intermediate circuit exceeds a set limit value, energy is discharged into the attenuation circuit fitted in parallel with the winding of the brake. In this case the attenuation circuit functions as an overvoltage protector of the winding of the brake.

In one embodiment of the invention a capacitor is connected between the rails that transfer output current and return current to the intermediate circuit of the brake control circuit. The capacitor in this case functions as an energy store, in which the energy returning to the intermediate circuit from the winding of the brake is stored. The energy stored in the capacitor can also then be re-used as magnetization energy of the winding of the brake. If the intermediate circuit is made to be unregulated, e.g. by rectifying the voltage of the AC voltage source with a diode rectifier, the variation of intermediate circuit voltage can also be compensated with the capacitor.

In one embodiment of the invention the current of the brake is adjusted towards the set reference for brake current by switching the first controllable switch with short pulses.

In one embodiment of the invention a first controllable switch is fitted in series with the winding of the brake, which switch is switched with short pulses, for controlling the electricity supply of the winding of the brake. A second controllable switch, which when controlling the brake is kept continuously closed at the same time as the first controllable switch is switched with short pulses, is further fitted in series with a winding of the brake. The electricity supply from the intermediate circuit to the winding of the brake is arranged to be disconnected by opening the second controllable switch. Since the second switch is continuously closed when current is flowing, no switching losses whatsoever occur in the switch, but instead only transmission losses, and therefore a switch that is dimensioned for smaller dissipation power can be used as a switch. In this case also a mechanical switch, such as a relay or a contactor, can be used as the second switch.

In one embodiment of the invention a first and a second switch are arranged to be controlled on the basis of the status data of the safety circuit of the elevator. In this case, when an operational nonconformance of the elevator system so requires it, the first and the second switch can be controlled open, in which case the brake closes immediately; on the other hand, the brake-opening and/or brake-closing force can also be controlled by supplying current to the winding of the brake, if the detected operational nonconformance does not require immediate disconnection of the control of the brake. The safety circuit of the elevator can be formed of e.g. a safety circuit of an elevator that is, in itself prior art, with the safety contacts incorporated in said prior-art safety circuit. The safety circuit can also be implemented using an electronic monitoring unit, which is made from prior-art electronic safety devices complying with the required design criteria. The monitoring unit can in this case comprise e.g. a duplicated processor control, which is in connection with the sensors that measure the safety of the elevator as well as with the actuators that perform the procedures ensuring safety of the elevator via a communications channel between them. In this case the monitoring unit determines the status, i.e. operational state, of the elevator system on the basis of the measurement data of the safety sensors. A sensor that measures safety can be e.g. one of the following: a safety switch of a landing door of the elevator, a final limit switch of the elevator, a safety switch that is temporarily activated and that determines a temporary safety space at the top end and/or at the bottom end of the elevator hoistway, and also a monitoring unit of the overspeed of the elevator/overspeed governor safety switch; the sensor can also be, for instance, an electronic sensor, such as a proximity sensor, corresponding to one of the aforementioned safety switches. The actuator performing the procedures that ensure the safety of the elevator can be e.g. the brake control circuit of the machinery brake, and also the control circuit of the gripping apparatus of the elevator car.

In one embodiment of the invention when detecting a line-to-earth short-circuit of the brake, only the first switch is closed, and the line-to-earth short-circuit is in this case determined on the basis of the current flowing through the first switch. In this case if there is a line-to-earth short-circuit in the winding of the brake, current starts to flow through the first switch after the switch closes.

The elevator system according to the invention comprises a movement control system, which adjusts the movement of the elevator car according to a set movement reference. The elevator system comprises a brake control circuit, which brake control circuit comprises a first switch that controls the electricity supply of the winding of the brake, which switch is switched in a controlled manner with short pulses by the control of the electricity supply of the winding of the brake, and thus the braking function is controlled. Movement control system refers in this context to those devices and softwares that perform the regulating function of the movement of the elevator car. These include at least one of the following: the sensors that determine the position and/or movement of the elevator car and/or the elevator machine and interfaces of said sensors, the position determining apparatuses of the elevator car fitted in connection with the floor levels and interfaces of said apparatuses, and also the regulating circuit of movement of the elevator car and softwares of said circuit.

In one embodiment of the invention the safety circuit of the elevator checks in connection with an emergency stop the operating condition of the movement control system. The operating condition of sensors that determine movement of the elevator car can be checked by comparing the congruity of the measuring data of at least two different sensors. If the measuring data differ from each other by more than the set limit value, it can thus be deduced that the movement control system has failed. Malfunctioning of the movement control system can also be determined e.g. when the position determination of the elevator car does not succeed; malfunctioning can also be determined if the movement of the elevator car, such as the measured run-time speed and/or acceleration of the elevator car, or e.g. the measured speed and/or deceleration of the elevator car during an emergency stop differs from its set reference value by more than the limit value for the maximum permitted deviation. Generally the safety circuit in this case at the same time disconnects the electricity supply of the elevator motor.

In one embodiment of the invention when an operational nonconformance of the movement control system is detected, the safety circuit disconnects the electricity supply to the winding of the brake by opening a first and a second controllable switch. In this case the electricity supply to the winding quickly ceases completely, in which case also the brake shoe presses against a moving part of the elevator machine with as great a force as possible, and the brake closes with as short delay as possible. Although the deceleration exerted in this case on an elevator passenger may indeed feel uncomfortable, this type of control of the brake is advantageous in situations determined by the safety circuit of the elevator, such as when the elevator car is situated nearer to the end of the elevator hoistway than the set limit value, or when detecting an operational nonconformance of the movement control system of the elevator, such as a fault situation. The aforementioned type of brake control can be used also e.g. in a situation in which an overload has been loaded into the elevator car.

In one embodiment of the invention when the movement control system is detected to be in working order, the safety circuit permits electricity supply to the winding of the brake with the control of the first and the second controllable switch, and the movement control system in this case regulates by means of the brake control circuit the movement of the elevator car during a emergency stop by adjusting the current of the winding of the brake and thus the braking force of the brake of the elevator so that the movement of the elevator car approaches the reference set for movement. In this case movement, such as the speed and/or deceleration and/or position, of the elevator car during an emergency stop can thus be adjusted in a controlled manner, in which case an emergency stop is more comfortable from the viewpoint of an elevator passenger.

In one embodiment of the invention the motor control unit of the elevator comprises a non-volatile memory, in which the parameters of the brake are stored, at least one of which parameters is the reference for the brake current and also the limit value for the voltage of the winding of the brake that corresponds to this, and the aforementioned parameters are transferred from the motor control unit to the brake control circuit via the communications channel made between these. The aforementioned parameters of the brake can in this case if necessary be stored in the non-volatile memory of the control card of the motor control unit, such as e.g. of the frequency converter, already in conjunction with manufacturing or delivery, in which case parameterization of the brake control circuit is simplified. Since the machinery brake is normally installed in the hoisting machine already before delivery of the hoisting machine, the parameters of the winding of the brake can thus be fitted in conjunction with the own machinery-specific parameters of the motor control unit, which facilitates installation and commissioning of a hoisting machine. It is also possible that the motor control unit learns the necessary parameters of the hoisting machine only in the installation phase, e.g. by injecting voltage signals and/or current signals into the winding of the motor, and selecting from the table stored in the memory the parameters of the brake corresponding to the learned machine parameters.

In one embodiment of the invention the voltage of the winding of the brake is limited to the limit value for the voltage of the winding of the brake at any given time with the control of the first controllable switch. In this case the brake control circuit comprises a regulating loop, in which the brake is controlled by adjusting the voltage between the poles of the winding of the brake and/or the current flowing through the winding by switching the first controllable switch with short pulses. The regulating loop also comprises a measuring feedback for the current between the poles of the brake and/or the current flowing through the brake, and thus the voltage between the poles of the winding of the brake is limited to its set limit value by means of the aforementioned measuring feedback.

One elevator system according to the invention comprises at least two brakes of the elevator, both of which brake a moving part of the same elevator machine. In one embodiment of the invention the electricity supply to the winding of the first brake is in this case controlled by switching the first controllable switch with short pulses. A third controllable switch is further fitted to the brake control circuit, which switch is fitted in series with the winding of the second brake, and the electricity supply to the winding of the second brake is controlled by switching the aforementioned third controllable switch with short pulses. In this case also the electricity supply to both the aforementioned windings occurs via the same intermediate circuit of the brake control circuit, which simplifies the construction of the brake control circuit.

In one embodiment of the invention a fourth controllable switch is fitted to the brake control circuit, and the electricity supply from the intermediate circuit to the winding of the first brake is arranged to be disconnected by opening the second controllable switch, and the electricity supply from the intermediate circuit to the winding of the second brake is arranged to be disconnected by opening the fourth controllable switch.

In one embodiment of the invention the brake control circuit is arranged to close at first only the first brake in connection with an emergency stop, and the brake control circuit is arranged to close also the second brake, if the movement of the elevator car determined by the movement control system during an emergency stop decelerates by less than the minimum deceleration during an emergency stop according to the reference set for movement. In this case the braking force of the elevator machine and thus the deceleration of the elevator car can be increased e.g. in steps, so that the braking force increases to be greater the more the machinery brake closes to brake the movement of the elevator machine.

BRIEF DESCRIPTION OF THE DRAWINGS

In the following, the invention will be described in more detail by the aid of some examples of its embodiments, which in themselves do not limit the scope of application of the invention, with reference to the attached drawings, wherein.

DETAILED DESCRIPTION OF THE PREFERRED EMBODIMENTS

Figure 1:
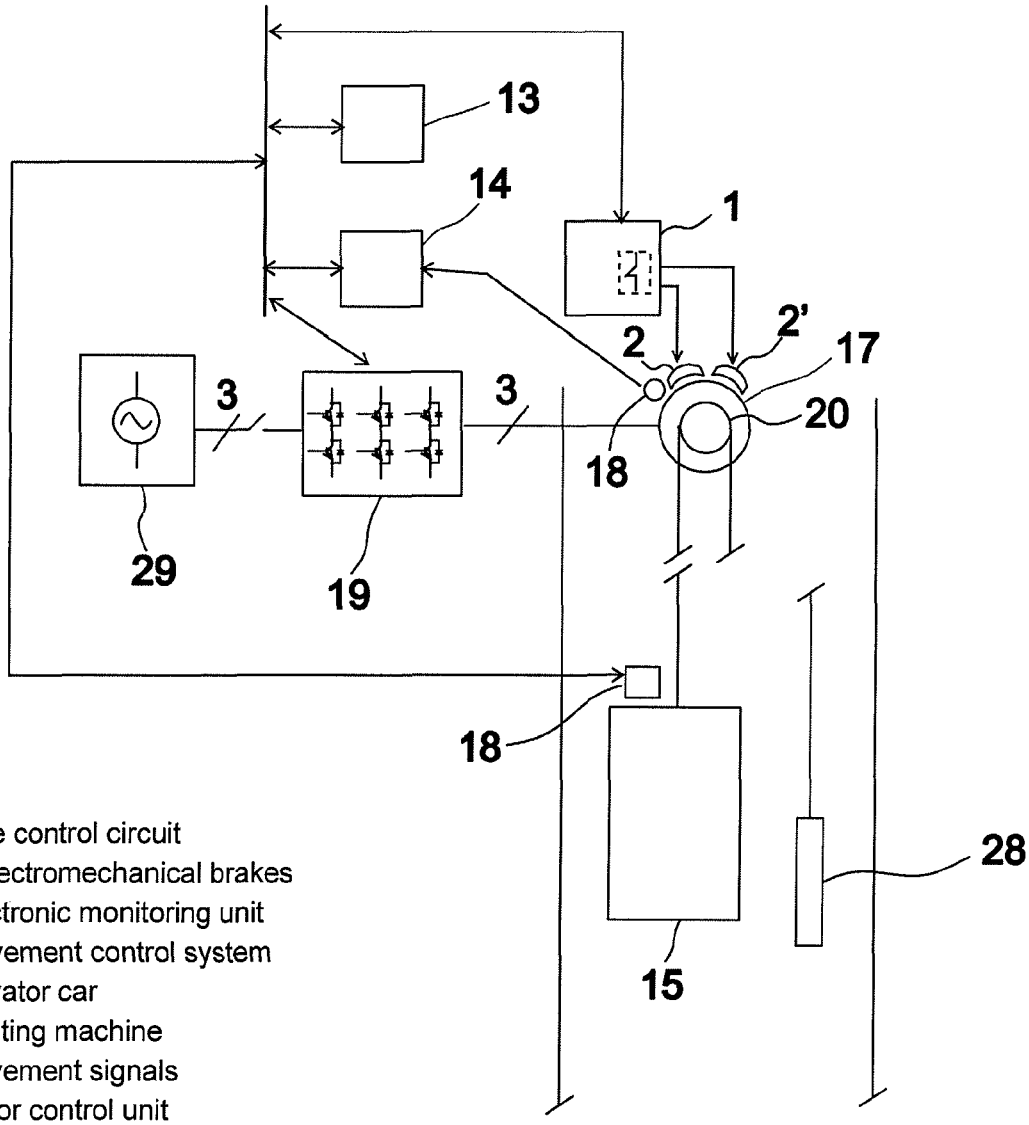
FIG. 1 presents one elevator system according to the invention

In the elevator system according to FIG. 1, the elevator car 15 and the counterweight 28 are supported with elevator ropes passing via the traction sheave 20 of the elevator machine 17. The traction sheave is integrated into the rotor of the elevator machine. A communication connection is arranged between the different control units of the elevator system. The structure of this type of serial mode communications channel is prior art in its basic principles, and it is not presented here in more detail. It should be noted, however, that the communication of the electronic monitoring unit 13 that monitors the safety of the elevator system with the sensors that measure the safety of the elevator system and the actuators that perform the procedures that ensure the safety of the elevator system occur redundantly such that the electronic monitoring unit 13 both sends and receives, either along parallel data buses simultaneously or along the same data bus consecutively, two separate data that determine the same safety function of the elevator system. In this case the electronic monitoring unit 13 e.g. receives movement data 18 of the elevator car via two channels from an acceleration sensor fixed in connection with the elevator car, from an encoder connected to a rotating part 20 of the hoisting machine 17, or from a signal of both the acceleration sensor and the encoder; in the lattermost case it is sufficient to satisfy the two-channel requirement that only a singe-channel movement signal is generated from both movement data. If the separate movement signals 18 that using two channels determine the same movement data referred to above differ from each other by more than the set limit value, the electronic monitoring unit 13 deduces that at least one measurement of movement data is malfunctioning and thus determines an operational nonconformance of the movement control system 14 of the elevator system. The electronic monitoring unit as well as the sensors and actuators connected to the safety of the elevator system in this case form the safety circuit of the elevator.

The power supply of the permanent-magnet synchronous motor 17 that moves the elevator car 15 occurs from the electricity network 28 with a motor control unit 19, with which a rotating current vector that moves the rotor is formed in a way that is, in itself, prior art. The movement control system 14 measures the speed 18 of the traction sheave of the elevator motor with an encoder. The current to be supplied to the elevator motor 17 is adjusted with the frequency converter such that the measured speed of the traction sheave 20, and thus also the speed of the elevator car, adjusts to correspond to the reference for speed. The aforementioned reference for speed is updated as a function of the position of the elevator car 15 moving in the elevator hoistway.

Two electromechanical brakes 2, 2', which both connect to the braking surface of a rotating part to prevent movement of the traction sheave 20, are fitted in connection with a rotating part of the elevator machine 17. Control of the brake occurs by supplying brake current to the excitation winding 3, 3' of both brakes with a brake control circuit 1. The brake control circuit comprises a first switch that controls the electricity supply of the winding of the brake, which switch is switched in a controlled manner with short pulses by the control of the electricity supply of the winding of the brake, and thus the braking function is controlled.

As mentioned above, the electronic monitoring unit 13 measures the state of the sensors that monitor the safety of the elevator system and deduces any operational nonconformance of the elevator system. On the basis of an operational nonconformance of the elevator system, the safety circuit of the elevator can perform an emergency stop. In this case, if e.g. the contact that measures the position of a landing door detects opening of the landing door during an elevator run, the electronic monitoring unit 13 initiates an emergency stop. An emergency stop can often be initiated also manually, e.g. by using an emergency stop button fitted into the elevator car, the status of which is read by the monitoring unit 13. The electronic monitoring unit 13 determines the operating condition of the movement control system 14 in connection with an emergency stop by comparing two movement signals that determine the movement of the elevator car, and that are generated with a different sensor, with each other in the manner described above. If the movement signals correspond to each other with sufficient accuracy, the monitoring unit 13 further compares one of the movement signals to the limit values set for permitted movement of the elevator car; if the movement is in this case in the permitted range set by the limit values, the monitoring unit 13 deduces that the movement control system 14 is in working order. Conversely, if the movement signals 18 in this case differ from each other by more than the limit value, or if the movement of the elevator car deviates to outside the range of permitted movement set by the limit values, the monitoring unit deduces an operational nonconformance of the movement control system 14.

When executing an emergency stop the monitoring unit 13 also disconnects the electricity supply of the elevator motor 17 by controlling open at least the switches of the motor bridge of the frequency converter as well as also any contactor or corresponding contacts possibly disposed between the electricity network 29 and the motor control unit 19.

When it detects an operational nonconformance of the movement control system 14, the electronic monitoring unit 13 sends to the brake control circuit 1 a control command, on the basis of which the brake control circuit 1 disconnects the electricity supply to the windings 3, 3' of the brake completely as soon as possible. In this case also the machinery brakes 2, 2' engage with a moving part of the machine with as great a force as possible, and the elevator car stops with maximum deceleration. In this case the deceleration during an emergency stop can be e.g. approx. 0.66 G. The electricity supply to the windings 3, 3' of the brake can be disconnected in a corresponding manner also, e.g. in connection with an electrical power outage of the elevator system.

When it detects that the movement control system 14 is in working order, the electronic monitoring unit 13 sends to the brake control circuit 1 a control command, on the basis of the supply of electricity to the winding of the brake is permitted also in connection with an emergency stop. In this case the movement control system 14 adjusts by means of the brake control circuit 1 the speed 18 of the elevator car 15 towards the speed reference to be used during an emergency stop so that the elevator car stops in a controlled manner with the deceleration set by the speed reference. The value of deceleration can in this case vary, according to the operating circumstances and the deceleration stage, and it can be e.g. approx. 0.33 G.

Figure 2:
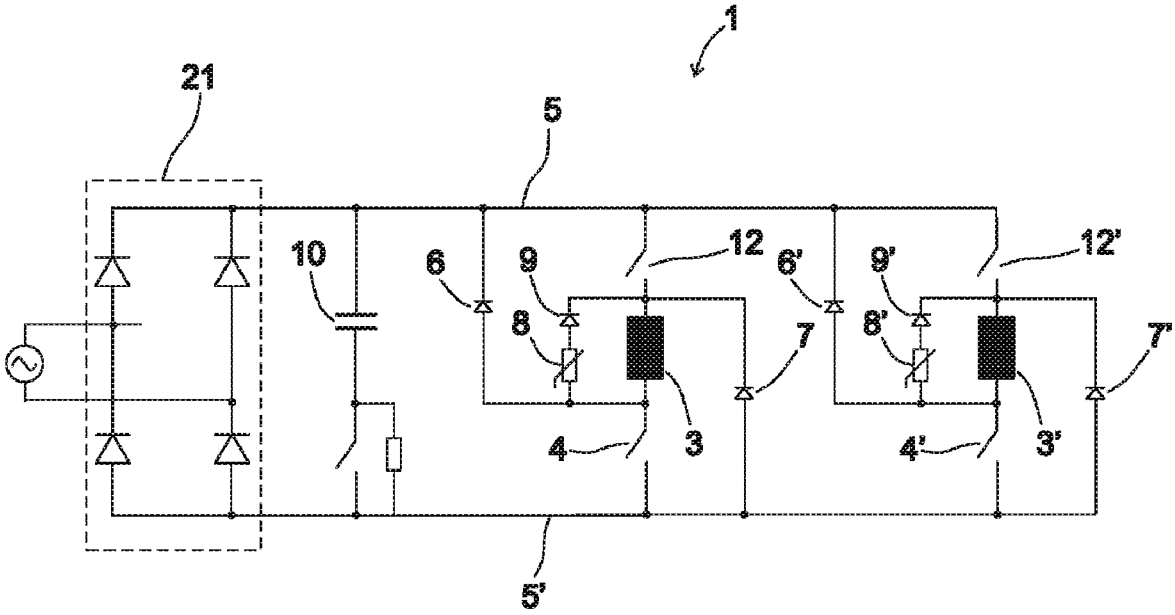
FIG. 2 presents one brake control circuit according to the invention

FIG. 2 presents the main circuit of one brake control circuit 1 according to the invention. Also the main circuit of the brake control circuit dealt with in FIG. 1 can be this type; on the other hand, the brake control circuit 1 to be presented is also suited to elevator systems in which a conventional safety circuit is used in the safety circuit of the elevator instead of an electronic control unit 13. In this case the electricity supply to the brake control circuit 1 is fitted to be disconnected with a normally open contact, the control of which disconnects the safety circuit when it opens.

A first controllable switch 4 is fitted in series with the winding 3 of the first brake, which switch is switched with short pulses when controlling the electricity supply of the first brake 2. The first controllable switch can be implemented with e.g. an IGBT transistor, a MOSFET transistor or with another solid-state switch. The switching frequency of the first switch is essentially greater than the frequency of the AC voltage source supplied to the brake control circuit 1, usually by at least several kilohertz. A second controllable switch 12, which when controlling the brake is kept continuously closed at the same time as the first controllable switch 4 is switched, is further fitted in series with the winding of the first brake. The intermediate circuit 5 is made by rectifying the voltage of the AC voltage source with a diode rectifier 21. Another network commutating rectifier can also be used instead of a diode rectifier, in which case the diodes of at least the upper or the lower branch can be replaced with e.g. thyristors. The intermediate circuit can also be formed to be regulated by using e.g. some prior-art DC/DC transformer or AC/DC transformer; the brake control circuit 1 can also comprise a transformer, with which the winding of the brake is galvanically isolated from the AC voltage source. A capacitor 10 is connected between the rails 5, 5' that transfer output current and return current to the intermediate circuit of the brake control circuit 1. By means of the capacitor the fluctuations in voltage produced by the diode rectifier 21 can be compensated. A capacitor 10 can be connected and isolated from the intermediate circuit with a switch fitted in series with the capacitor.

The electricity supply of the winding 3 of the brake can be disconnected by opening the second controllable switch 12. When in addition the first controllable switch 4 is opened, the current flowing in the winding, and thus the energy stored in the winding, starts to discharge via the diodes 6, 7 forming the release branch of the intermediate circuit 5 of the brake control circuit. The interference produced by commutation can be reduced by opening the first controllable switch 4 before the second controllable switch 12 is opened. After the switches have opened, the magnetization energy discharged from the winding 3 of the brake starts to be stored in the intermediate circuit capacitor 10, and the voltage of the capacitor starts to increase. After the voltage has increased sufficiently, the varistor 8 or corresponding fitted in parallel with the winding switches to be conductive via the diode 9. The varistor then starts to discharge the energy of the winding as heat, limiting at the same time the increase in intermediate circuit voltage. Since only a part of the energy of the winding changes in this case to heat in the attenuation circuit formed by the varistor 8 and the diode 9, and the rest of the energy is stored in the intermediate circuit capacitor 10, the dimensioning of the attenuation circuit 8, 9 can be reduced.

A third controllable switch 4' and also a fourth controllable switch 12' are fitted in series with the second winding 3' of the brake. The operation of the third controllable switch 4' is in this case similar to that of the first controllable switch 4, and likewise the operation of the fourth controllable switch 12' corresponds to the operation of the second controllable switch 12. Discharge of the energy of the winding 3' of the second brake also occurs via the second release branch 6', 7' in a corresponding manner as in the case of the first winding, so that the operation of their main circuit parts are not separately described here. What must be noted instead, however, is that in this case the electricity supply to the windings of both the first and of the second brake occurs from the same intermediate circuit; also both the first 6, 7 and the second 6', 7' release branch discharge energy into the same intermediate circuit, in which case the construction of the main circuit of the brake control circuit is simplified.

Figure 3A:
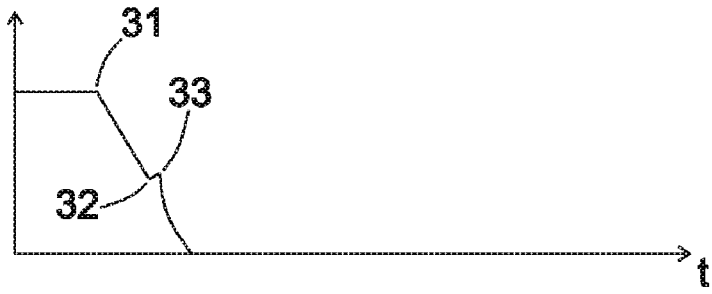
FIGS. 3*a*-3*d* present some emergency stop situations
Figure 3B:
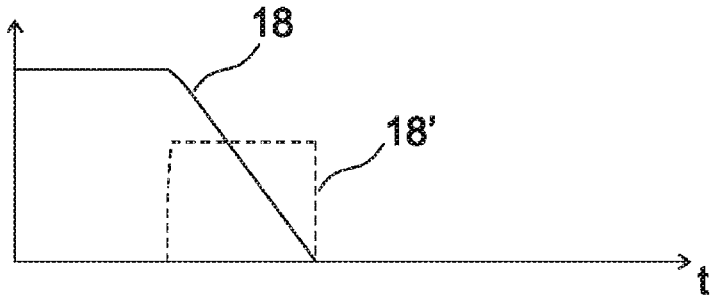

FIGS. 3*a*-3*d* present some emergency stop situations of an elevator, by means of which e.g. the operation of the brake control circuit of FIG. 2 is illustrated. Here, for the sake of clarity and to simplify the description, the machine of the elevator is braked with only one brake, the electricity supply of the winding of which brake is controlled. It is, however, possible that the machine of the elevator comprises at least two brakes, in which case the current supply to the windings of both of them is controlled; in this case the currents of the windings can be essentially of equal magnitude, but they can also if necessary be selected to differ from each other, particularly if the constructions of the brakes in this case differ from each other. The construction of the brake used is in its basic principle of the type presented in FIG. 5. FIG. 3*a* presents a graph of the current of the winding 3 of the brake of an elevator in a situation in which the current supply to the winding is disconnected by opening the first 4 and the second 12 controllable switch. At the moment in time 31 the switches open, at the moment 32 the current 11 of the winding 3 of the brake has decreased so much that the pushing force exerted by the helical springs 24, 24' on the brake shoe 25' exceeds the attraction force produced by the current flowing in the winding 3 of the brake, in which case the brake shoe 25' starts to move towards the braking surface 26; at the moment 33 the brake has closed, and in this case the brake pad 27 engages against the braking surface 26. After this the current goes to zero at the speed determined by the attenuation circuit and/or the release circuit, depending on the amount of magnetization energy committed to the winding. FIG. 3*b* presents the speed 18 and the deceleration 18' of an elevator car when the brake 2 is controlled in the manner presented in FIG. 3*a*. Since the current of the winding of the brake in this case decreases rapidly to zero, the brake pad engages to brake with its maximum force, in which case also the deceleration is great, preferably approx. 0.6 . . . 0.66 G, and the elevator car stops quickly with a short braking distance.

Figure 3C:
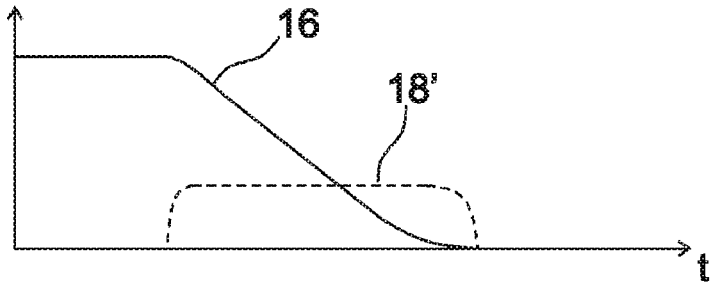
Figure 3D:
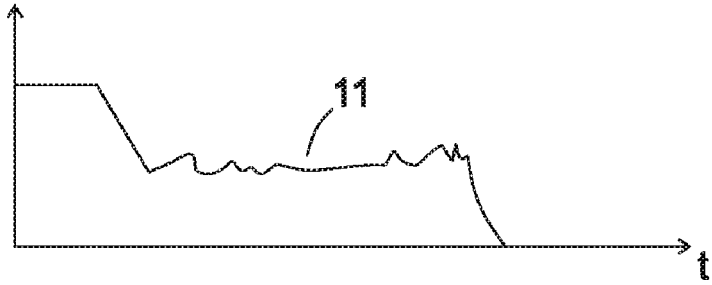

FIG. 3*c* presents the speed and deceleration of the elevator car in a situation in which the movement control system is verified as being in working order, and the brake is controlled by adjusting the current of the winding of the brake during an emergency stop by connecting with short pulses the first controllable switch 4, such as is explained in conjunction with the embodiments of FIGS. 1 and 2. In this case the movement control system 14 adjusts by means of the brake control circuit 1 the speed 18 of the elevator car 15 towards the speed reference used during an emergency stop so that the elevator car stops in a controlled manner with the deceleration set by the speed reference. The value of deceleration is here approx 0.33 G. FIG. 3*d*, on the other hand, presents a reference 11 for current in connection with an emergency stop according to FIG. 3*c*, in which case the current reference varies as a response to the adjustment magnitudes of the movement of the elevator car.

Figure 4A:
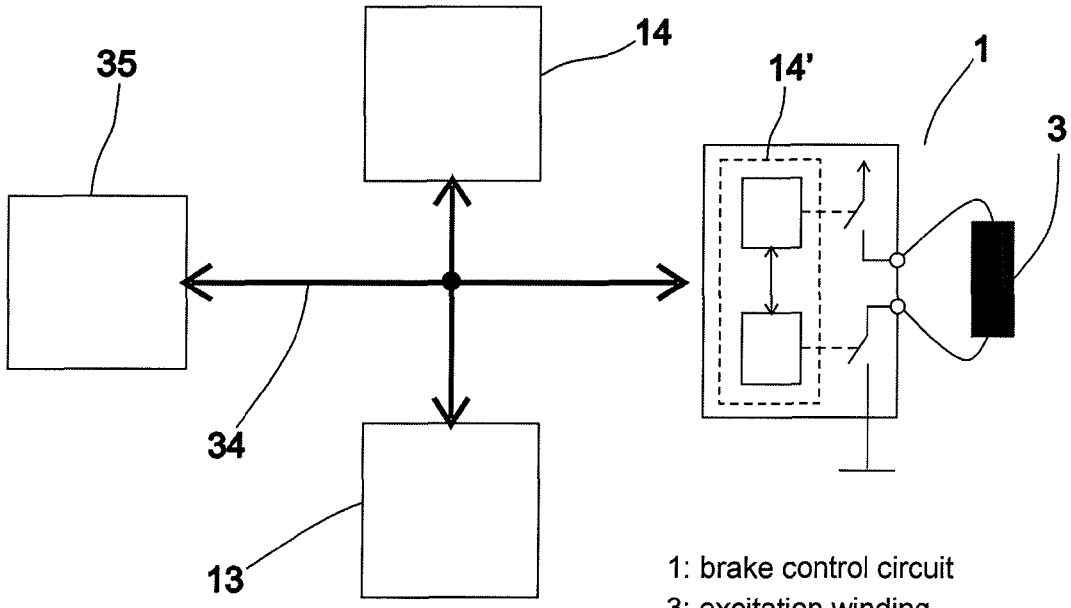
FIGS. 4*a*, 4*b* present the operation of a movement control system according to the invention
Figure 4B:
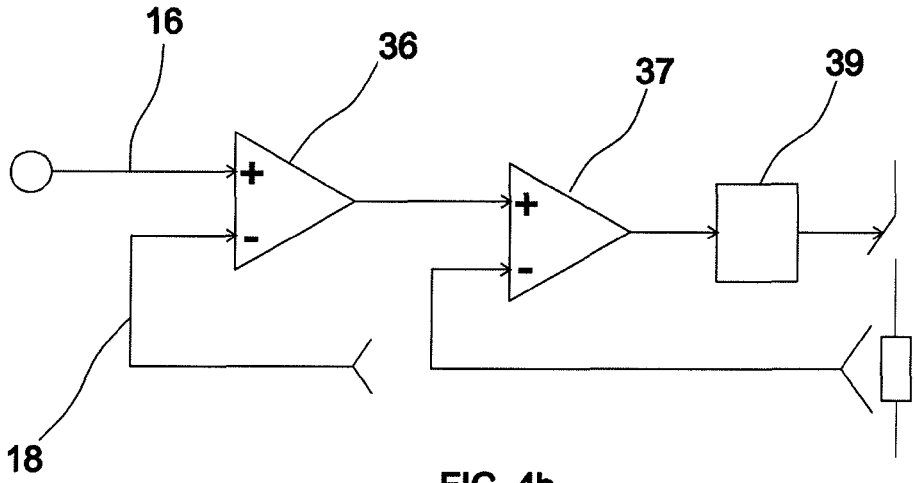

FIGS. 4*a*, 4*b* present in more detail one possible movement control system 14. For example, in an elevator system according to the embodiment of FIG. 1, one or more of the electronic safety devices presented here can be used, if necessary. According to FIG. 4*a*, a redundant serial communication bus 34 is fitted between the movement control system 14, the electronic monitoring unit 13, the monitoring unit 35 of the movement of the elevator car and the brake control circuit 1, via which bus the devices communicate between themselves using duplicated communication. The movement signals 18 that determine the movement of the elevator car are also transferred by two channels via the serial communication bus 34, in which case the movement signals can be read by one or more devices connected to the serial communication bus 34.

The brake control circuit 1 comprises a structurally duplicated redundant control 14', which is made from prior-art electronic safety devices complying with the required design criteria. The control 14' is made here with two microcontrollers that monitor the operation of each other, in which case a failure of one or other microcontroller is detected immediately.

The condition of the movement control system 14 is monitored on the basis of the movement signals of the elevator car, as is described above e.g. in the embodiment of FIG. 1. The monitoring of condition can be performed e.g. with an electronic monitoring unit 13 or with the monitoring unit 35 of the movement of the elevator car, which is also designed to be an electronic safety device. If on the basis of the movement signals 18 of the elevator car the movement control system 14 is detected to be in working order in connection with an emergency stop, the supply of current to the winding 3 of the brake is permitted, and the elevator car is stopped during an emergency stop in a controlled manner with a deceleration ramp by adjusting the current of the brake, using e.g. a deceleration of the magnitude of e.g. approx. 0.33 G. The redundant control 14' of the brake control circuit manages the adjustment of the movement of the elevator car as well as also the adjustment of the current of the winding 3 of the brake during an emergency stop, which redundant control thus also comprises certain functions of the movement control system. FIG. 4*b* presents in more detail the operation of the redundant control 14' of the brake control circuit during an emergency stop. The control 14' receives from the serial communication bus 34 the movement signals 18 of the elevator car generated by two different measuring apparatuses so that the first microcontroller receives the movement signal of the first measuring apparatus and the second microcontroller receives the corresponding movement signal of the second measuring apparatus. After this the control 14' compares the movement signals with each other to ensure their correctness. If the signals differ from each other by more than the set limit value, the control 14' disconnects the current supply of the winding 3 of the brake by opening the first 4 and the second 12 controllable switch. Conversely, if the movement signals correspond to each other with sufficient accuracy, the redundant control 14' of the brake control circuit compares at least one of the movement signals to the limit value for permitted movement of the elevator car, such as e.g. to the limit value curve of the maximum permitted speed during an emergency stop, to the limit value curve of the minimum permitted deceleration during an emergency stop, and/or to the limit values that determine the permitted position of the elevator car in the elevator hoistway. If the movement of the elevator car in this case differs from what is permitted, the control 14' disconnects the current supply of the winding 3 of the brake by opening the first 4 and the second 12 controllable switch. It is also possible that a separate safety device, such as an electronic monitoring unit 13 or a monitoring unit 35 of the movement of the elevator car, manages the monitoring of the operating condition of the measuring signals of the movement of the elevator car and/or of the movement of the elevator car during an emergency stop. In this case the redundant control 14' of the brake control circuit can also receive a measuring signal 18 of the movement of the elevator car just on a single channel.

The redundant control 14' of the brake control circuit either generates a reference 16 for the movement of the elevator car during an emergency stop or one is already stored in the memory of the control. The regulator 36 of the movement of the elevator car forms a reference for the current of the brake in response to the difference between the reference for the movement of the elevator car and the measured movement signal of the elevator car. The control of the electricity supply of the winding of the brake adjusts the current of the winding of the brake towards the current reference formed with the current regulator 37, in which case the movement of the elevator car adjusts towards the reference for movement during an emergency stop. The control of the electricity supply of the winding of the brake also controls the controllable switch 4 of the brake control circuit with a switching reference, which is formed with a pulse-width modulator 39.

Figure 5:
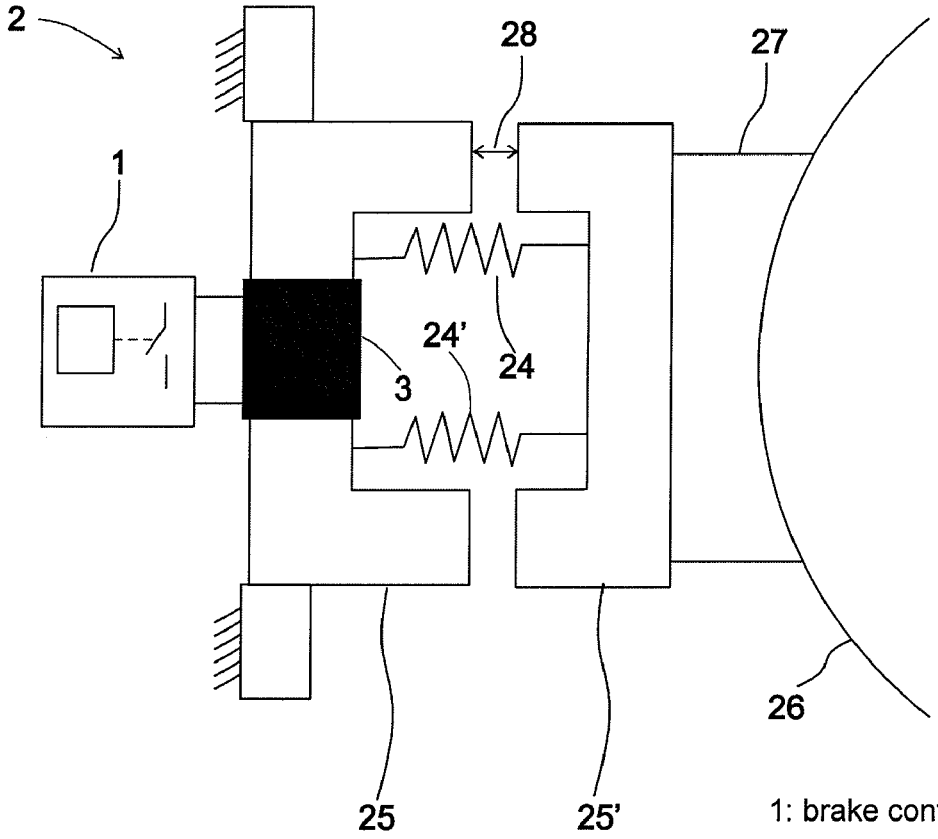
FIG. 5 presents a brake according to the invention.

FIG. 5 presents a schematic diagram of a brake 2 according to the invention. The electromechanical brake 2 comprises a magnetic circuit, which comprises at least two ferromagnetic parts 25, 25' fitted to move in relation to each other. Of the parts, the first 25 is fixed to a stationary part (not in figure) of the elevator machine, and the second part 25', i.e. the brake shoe, is attached to the brake pad 27, which is fitted to connect to the braking surface 26. In this case a thrusting force is exerted between the ferromagnetic parts 25, 25' via two helical springs 24, 24', which thrusting force presses the brake pad 27 to the braking surface 26. An excitation winding 3 is wound around the first part 25 of the ferromagnetic core of the magnetic circuit of the brake 2. The current supply to the excitation winding 3 produces a force of attraction between the ferromagnetic parts 25, 25', in which case when the current and at the same time the force of attraction progressively increase, the second part 25' of the magnetic circuit finally starts to move towards the first part 25, pulling at the same time the brake pad 27 away from the braking surface 26. The air gap 28 of the magnetic circuit between the first 25 and the second 25' part starts to decrease, and finally goes to zero when the magnetic circuit closes. At the same time the brake opens, and the traction sheave can rotate. Correspondingly, when the current of the excitation winding 3 progressively decreases, the second part 25' of the magnetic circuit finally starts to move away from the first part 25, pressing at the same time the brake pad 27 against the braking surface 26. In this case the brake engages to prevent movement of the traction sheave. Since the force exerted on the brake pad 27 by the helical springs 24, 24' can be reduced by supplying current to the excitation winding 3, the braking force can thus also be reduced with the current control of the brake e.g. in connection with an emergency stop of the elevator.

The adjustment during an emergency stop of the movement of the elevator car by adjusting the braking force of the machinery brake presented as an embodiment of the invention also requires that the condition of the machinery brakes are monitored and that the brakes are verified as being in operating condition before starting the adjustment. A number of methods are presented in prior art for monitoring the condition of a brake, and they will not be examined in more detail here.

Figure 6:
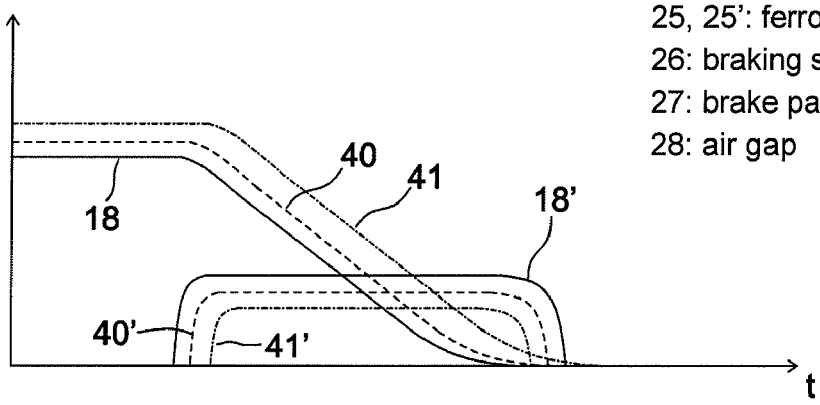
FIG. 6 presents the monitoring of the movement of the elevator car during an emergency stop.

FIG. 6 presents the monitoring of the movement of the elevator car during an emergency stop. The monitoring of movement presented in the embodiments described above can be implemented, but it is not necessarily implemented in the way presented here. According to FIG. 6, a first limit value curve 40 is determined for the maximum speed of the elevator car during an emergency stop, to which the measured speed 18 of the elevator car is compared. If the measured speed 18 exceeds the first limit value curve 40 of permitted speed, the electricity supply to the winding of the brake is disconnected as quickly as possible. If the speed of the elevator car nevertheless continues to increase, exceeding the second limit value curve 41, after the current of the winding of the brake has been disconnected, the safety gear of the elevator car is also controlled. The aforementioned second limit value curve 41 is determined for larger speeds than the first limit value curve 40 throughout its definition range so that the first 40 and the second 41 limit value curve of speed never cross each other.

Also a first limit value curve 40' is determined for the minimum permitted deceleration of the elevator car in FIG. 6, to which the measured deceleration 18' of the elevator car is compared. If the measured deceleration falls below the first limit value curve 40' of permitted deceleration, the electricity supply to the winding of the brake is disconnected as quickly as possible. If the deceleration of the elevator car nevertheless continues to decrease, falling below the second limit value curve 41', after the current of the winding of the brake has been disconnected, the safety gear of the elevator car is also controlled. The aforementioned second limit value curve 41' is determined for smaller decelerations than the first limit value curve 40' throughout its definition range so that the first 40' and the second 41' limit value curve of deceleration never cross each other.

Monitoring of the movement of the elevator car during an emergency stop can also be implemented by monitoring just the speed of the elevator car or the deceleration of the elevator car in the manner described above.

The aforementioned limit value curves 40, 40', 41, 41' of deceleration and/or of speed of the elevator car during an emergency stop are here determined as a function of time, but they can also be determined as a function of e.g. the position of the elevator car in the elevator hoistway; and particularly in that way if the elevator car is situated in the end zone of the elevator hoistway during an emergency stop.

It is obvious to the person skilled in the art that different embodiments of the invention are not limited to the example described above, but that they may be varied within the scope of the claims presented below.

It is also obvious to the skilled person that the solution according to the invention can be applied in an elevator system with counterweight as well as in an elevator system without counterweight.

It is obvious to the person skilled in the art that the structure of a brake presented in FIG. 5 is only an example, and that the effect of the invention can be achieved with many different structures.

It is further obvious to a person skilled in the art that one or more of the aforementioned electronic devices can also be integrated together e.g. onto the same circuit card/into the same control unit.

The invention claimed is:

1. A brake control circuit, comprising:

a first controllable switch that controls electricity supply of a winding of a brake, wherein the first controllable switch is switched in a controlled manner with short pulses by a control circuit of the electricity supply of the winding of the brake, and thus the braking function is controlled; and a second controllable switch, wherein the first controllable switch, the winding of the brake and the second controllable switch are electrically connected in series, and the first controllable switch and the second controllable switch are electrically connected to opposite ends of the winding of the brake, respectively.

2. A brake control circuit, comprising:

a first controllable switch that controls electricity supply of a winding of the brake, wherein the first controllable switch is switched in a controlled manner with short pulses by a control circuit of the electricity supply of the winding of the brake, and thus the braking function is controlled, wherein after the electricity supply of the winding of the brake has been disconnected, the energy stored in the winding is discharged into an intermediate circuit of the brake control circuit via release branch.

3. A brake control circuit, comprising:

a first controllable switch that controls electricity supply of a winding of the brake, wherein the first controllable switch is switched in a controlled manner with short pulses by a control circuit of the electricity supply of the winding of the brake, and thus the braking function is controlled, wherein when voltage of the intermediate circuit exceeds a set limit value, energy is discharged into an attenuation circuit electrically connected in parallel with the winding of the brake.

4. A brake control circuit, comprising:

a first controllable switch that controls electricity supply of a winding of the brake, wherein the first controllable switch is switched in a controlled manner with short pulses by a control circuit of the electricity supply of the winding of the brake, and thus the braking function is controlled, wherein a capacitor is connected between two rails that transfer output current and return current to an intermediate circuit of the brake control circuit.

5. The brake control circuit according to claim 1, wherein a current of the brake is adjusted towards a set reference current by switching the first controllable switch with the short pulses.

6. The brake control circuit according to claim 1, wherein the second controllable switch, when controlling the brake, is kept continuously closed at the same time as the first controllable switch is switched with the short pulses; and the electricity supply from an intermediate circuit to the winding of the brake is arranged to be disconnected by opening the second controllable switch.

7. The brake control circuit according to claim 1, wherein the first and second controllable switches are arranged to be controlled based on status data of a safety circuit of the elevator.

8. The brake control circuit according to claim 1, wherein when detecting a line-to-earth short-circuit of the brake only the first switch is closed, and the line-to-earth short-circuit is in this case determined based on a current flowing through the first switch.

9. A elevator system, comprising:

a movement control system, which adjusts movement of the elevator car according to a set reference current, and a brake control circuit according to claim 1, for controlling the brake of the elevator.

10. The elevator system according to claim 9, further comprising a safety circuit, wherein the safety circuit detects an operating condition of the movement control system and initiates an emergency stop based on the detected operating condition of the movement control system.

11. The elevator system according to claim 10, wherein when the detected operating condition of the movement control system is abnormal, the safety circuit disconnects the electricity supply to the winding of the brake by opening the first controllable switch and the second controllable switch.

12. The elevator system according to claim 10, wherein when the detected operating condition of the movement control system is normal, the safety circuit permits electricity supply to the winding of the brake with the control of the first controllable switch and the second controllable switch; and the movement control system regulates by the brake control circuit the movement of the elevator car during the emergency stop by adjusting the current of the winding of the brake and thus a braking force of the brake of the elevator so that a speed of the elevator car approaches a set reference speed.

13. The elevator system according to claim 9, wherein the motor control unit of the elevator comprises a non-volatile memory, in which the parameters of the brake are stored, wherein the parameters include at least a set reference current of the winding of the brake, and a limit value for a voltage of the winding of the brake that corresponds to the set reference current of the winding of the brake, and wherein the parameters are transferred from a motor control unit to the brake control circuit via a communications channel between the motor control unit and the brake control circuit.

14. The elevator system according to claim 13, wherein the voltage of the winding of the brake is limited to the limit value for the voltage of the winding of the brake at any given time with the control of the first controllable switch.

15. A elevator system, comprising:

a movement control system, which adjusts movement of the elevator car according to a set reference current, at least a first brake and a second brake, wherein both the first brake and the second brake a moving part of the elevator machine; and a brake control circuit for controlling the first brake and the second brake, wherein the brake control circuit includes a first controllable switch that controls electricity supply of a winding of the first brake, wherein the first controllable switch is switched in a controlled manner with short pulses by a control circuit of the electricity supply of the winding of the first brake, and thus the braking function is controlled.

16. The elevator system according to claim 15, wherein the electricity supply to the winding of the first brake is controlled with the first controllable switch, wherein the brake control circuit further comprises a third controllable switch electrically connected in series with the winding of the second brake, and wherein the electricity supply to the winding of the second brake is controlled by switching the third controllable switch with short pulses.

17. The elevator system according to claim 15, wherein the brake control circuit further comprises a fourth controllable switch;

wherein the electricity supply from the intermediate circuit to the winding of the first brake is arranged to be disconnected by opening a second controllable switch, and wherein the electricity supply from the intermediate circuit to the winding of the second brake is arranged to be disconnected by opening the fourth controllable switch.

18. The elevator system according to claim 15, wherein when an emergency stop is initiated, the brake control circuit is arranged to close at first only the first brake; and the brake control circuit is arranged to further close the second brake, if a speed of the elevator car determined by the movement control system during the emergency stop decelerates by less than a minimum deceleration.

19. A method for controlling the brake of the elevator, comprising the steps of:

providing a movement control system into the elevator;

adjusting a speed of the elevator car according to a set reference speed;

providing a brake control circuit according to claim 1 into the elevator system; and controlling the brake of the elevator with the brake control circuit.

20. The method according to claim 19, further comprising:

determining whether the operating condition of the movement control system is normal or abnormal, and initiating an emergency stop when it is determined that the operating condition of the movement control system is abnormal, wherein the movement of the elevator car during the emergency stop is regulated with the movement control system by the brake control circuit by adjusting the current of the winding of the brake and thus a braking force of the brake of the elevator so that a speed of the elevator car approaches a set reference speed.

* * * * *